US005375912A

United States Patent [19]

Stulik et al.

[11] Patent Number: 5,375,912

[45] Date of Patent: Dec. 27, 1994

[54] RECLINING CHAIR

[76] Inventors: Edward L. Stulik, 7500 Hill Rd., Roseville, Calif. 95678; Bruce Burness, 1260 Yocum St., Pasadena, Calif. 91103

[21] Appl. No.: 99,186

[22] Filed: Jul. 29, 1993

Related U.S. Application Data

[63] Continuation-in-part of Ser. No. 954,582, Sep. 30, 1992, abandoned, which is a continuation-in-part of Ser. No. 565,791, Aug. 10, 1990, abandoned.

[51] Int. Cl.[5] ..... A47C 3/00

[52] U.S. Cl. ..... 297/304; 297/302

[58] Field of Search ..... 297/302, 304, 301, 300

[56] References Cited

U.S. PATENT DOCUMENTS 4,889,384 12/1989 Sulzer ..... 297/304 X
5,046,780 9/1991 Decker et al. ..... 297/304 X
5,160,184 11/1992 Faiks et al. ..... 297/304

FOREIGN PATENT DOCUMENTS 4220831 1/1993 Germany ..... 297/304

*Primary Examiner*—Peter R. Brown
*Attorney, Agent, or Firm*—Koda and Androlia

[57] ABSTRACT

A reclining chair including a support base, a chair having seat and back portions integrally formed, a lever arm fixed to and extending from a bottom and forward portion of the seat portion, a means for pivotally coupling the forward portion of the seat portion to the base portion such that the seat portion pivotally moves substantially about a pivoting axis passing through an expected vicinity of a pivoting axis of a knee joint of a person sitting in the reclining chair, a roller engaging with a surface of the lever arm, a mechanism for moving the roller along the surface of the lever arm and a coil spring pivotally coupled at one end to the support base and rotatably coupled to the roller at the other end.

4 Claims, 10 Drawing Sheets

RECLINING CHAIR

This application is a continuation-in-part of U.S. patent application Ser. No. 954,582 filed on Sep. 30, 1992,now abandoned which itself is a continuation-in-part of application Ser. No. 565,791 filed Aug. 10, 1990 now abandoned.

BACKGROUND OF THE INVENTION

I. Field of the Invention

This invention relates to reclining chairs and more particularly, to mechanisms for reclining the seat of such reclining chairs.

II. Prior Art

In the prior art there exists several different types of reclining chairs. All of these reclining chairs essentially perform the same function, that is the function of reclining; however, these prior art reclining chairs all have certain deficiencies.

In particular, when the chairs recline the feet of the person seated in the chair generally rises off of the floor as the front portion of the seat rises. Such a condition is particularly undesirable in reclining chairs utilized in offices.

The reclining mechanism is usually further provided with a spring which can be adjusted for preload for varying the biasing force against the reclining motion of the chair so that the chair does not fall backward; however, this spring can be adjusted only for preload and nothing else. Preload adjustability alone does not provide the capability for equal starting positions for large and small persons and does not provide the same feel throughout the reclining travel for large and small persons. As a result, chairs with only preload adjustability are optimized essentially for only one person. As a result, the chairs which are designed for people who are heavy cannot be utilized by people who are light in weight and vice-versa.

There does exist reclining chairs in the prior art which reduce or eliminate the first above described disadvantage; however, while these prior art reclining chairs may reduce or eliminate this disadvantage, they have disadvantages of their own. Examples of such disadvantages are that they are complex in structure and difficult and expensive to manufacture and do not feel equally comfortable during reclining motion for both light and heavy persons.

Examples of prior art reclining chairs which possess one more of the above disadvantages and which may have attempted to solve some of the above described disadvantages are described in the United States issued patents as follows:

| U.S. Pat. Nos. | | |
|---|---|---|
| 910,357 | 2,479,175 | 2,611,420 |
| 2,616,483 | 2,925,122 | 3,856,346 |
| 4,372,608 | 4,386,805 | 4,402,546 |
| 4,529,247 | 4,779,925 | 4,804,277 |
| 4,865,385 | 4,889,384 | 4,889,385 |
| 4,911,501 | 5,033,791 | 5,046,780 |

SUMMARY OF THE INVENTION

It is a general object of the present invention to solve the disadvantages described above.

In particular, it is a specific object of the present invention to provide a reclining chair which does not raise the feet of the person who is seated in the chair as it reclines, does not cause discomfort to the person seated in the chair as it reclines and is capable of being utilized equally comfortably by heavy and light persons.

It is yet another object of the present invention to provide a reclining chair with simultaneous adjustment of both the preload and the spring rate.

It is another object of the present invention to provide a reclining chair which will provide equal performance for a wide size range of persons.

It is still another object of the present invention to provide a reclining chair which includes a mechanism which is relatively simple in structure and easy to assemble and low in cost to manufacture.

In keeping with the principles and objects of the present invention, the objects are accomplished by a unique reclining chair including a support base, a chair comprising a seat portion and a back portion which are integrally formed with the seat portion, at least one lever arm fixed to and extending from a bottom and forward portion of the seat portion, a means for pivotally coupling the forward portion of the seat portion to the base portion such that the seat portion pivotally moves substantially about a pivoting axis passing through a pivoting axis of a knee joint of a person seated in the reclining chair, a roller engaging with an engaging surface of the lever arm, a means for moving the roller along the engaging surface and presetting an engaging position between the roller and the engaging surface and a coil spring pivotally coupled at one end to the support base and rotatably coupled to the roller at the other end.

BRIEF DESCRIPTION OF THE

The above mentioned features and objects of the present invention will become more apparent with reference to the following description taken in conjunction with the accompanying drawings wherein like reference numerals to the like elements and in which.

DETAILED DESCRIPTION OF THE INVENTION

Figure 1:
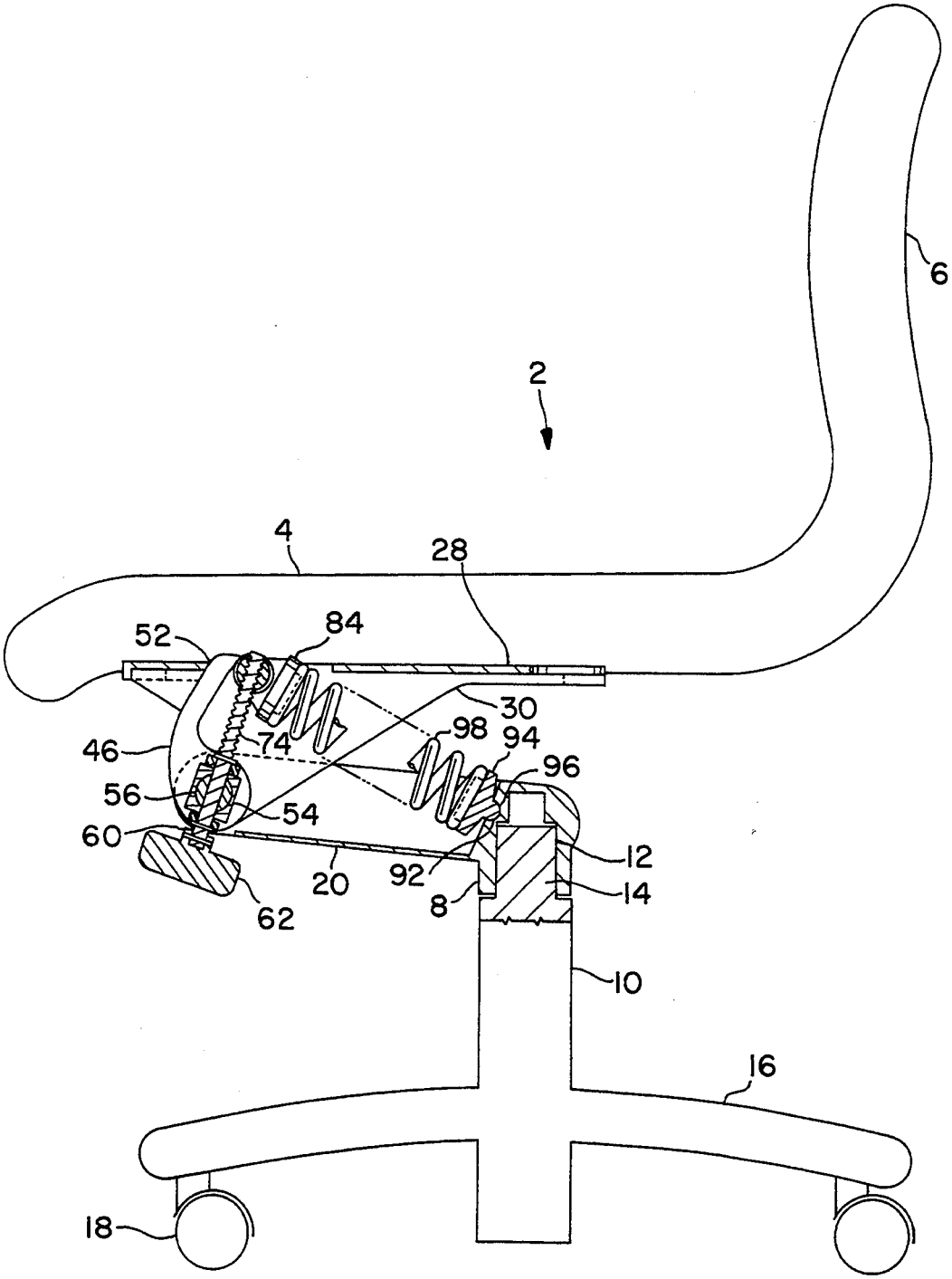
FIG. 1 is a partially cut away side view of a reclining chair in accordance with the teachings of the present invention.
Figure 2:
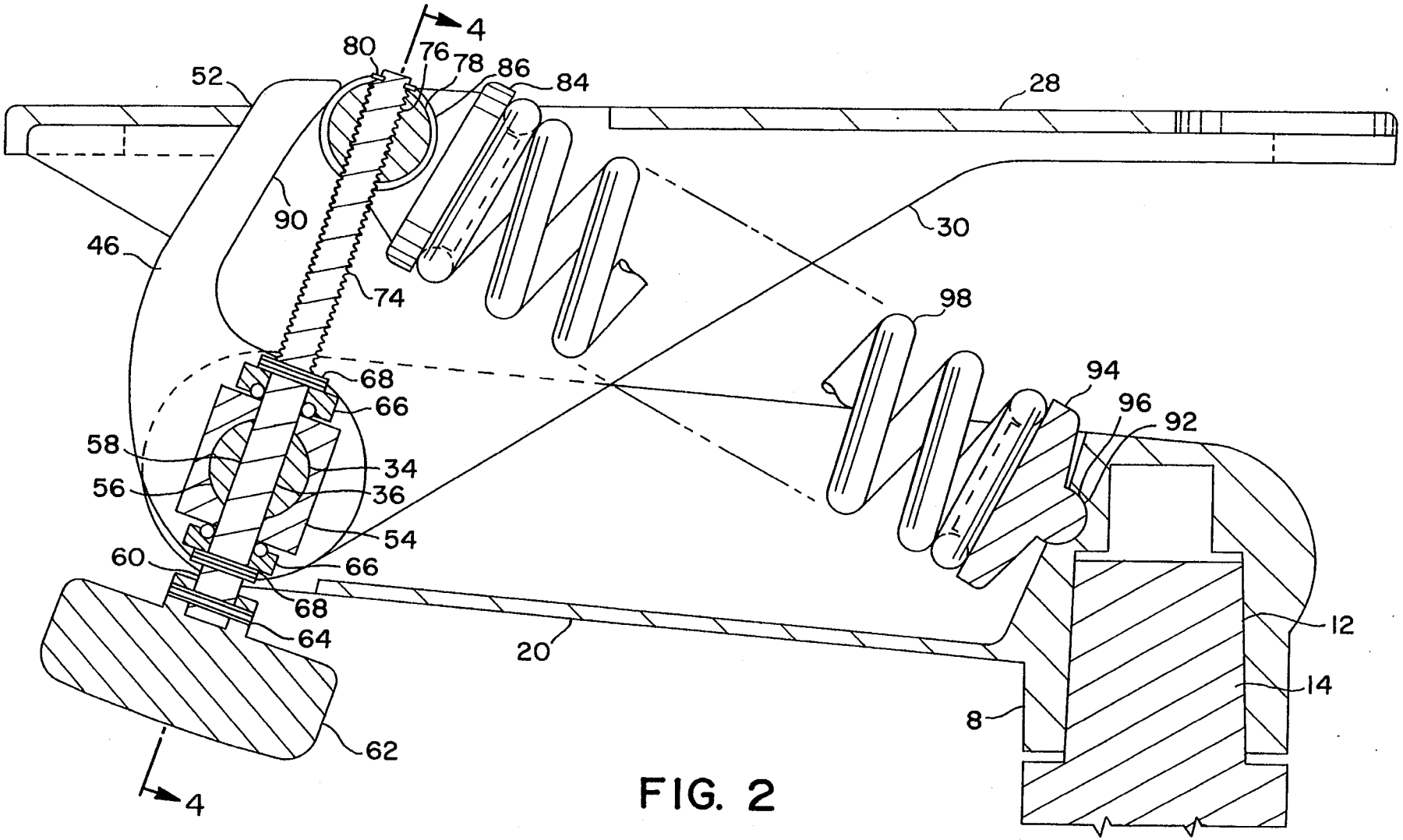
FIG. 2 is an enlarged cross sectional of the mechanism of FIG. 1.
Figure 3:
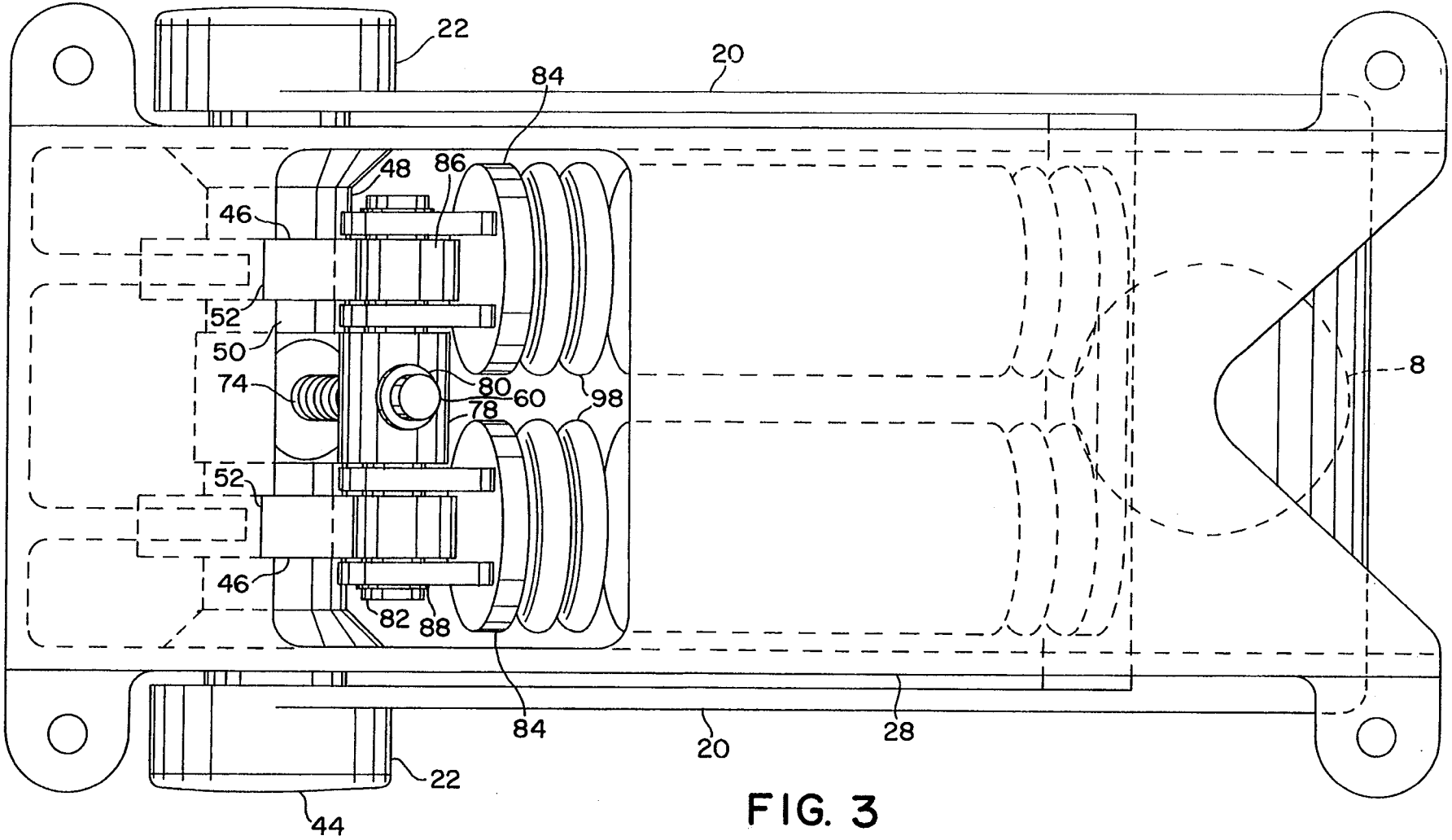
FIG. 3 is a top view of the mechanism of FIG. 1 with the chair portion removed.
Figure 4:
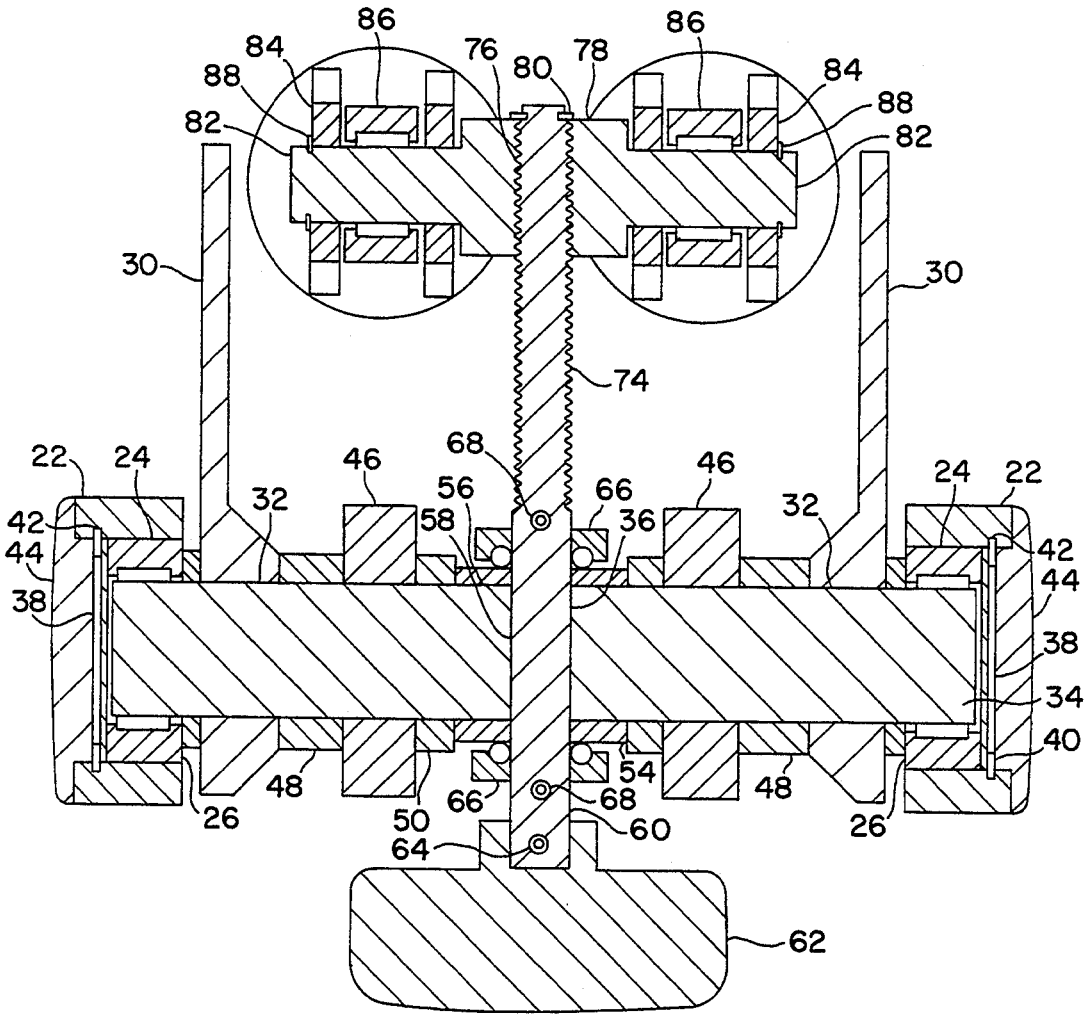
FIG. 4 is a cross section of FIG. 2 along the lines of 4—4.
Figure 5:
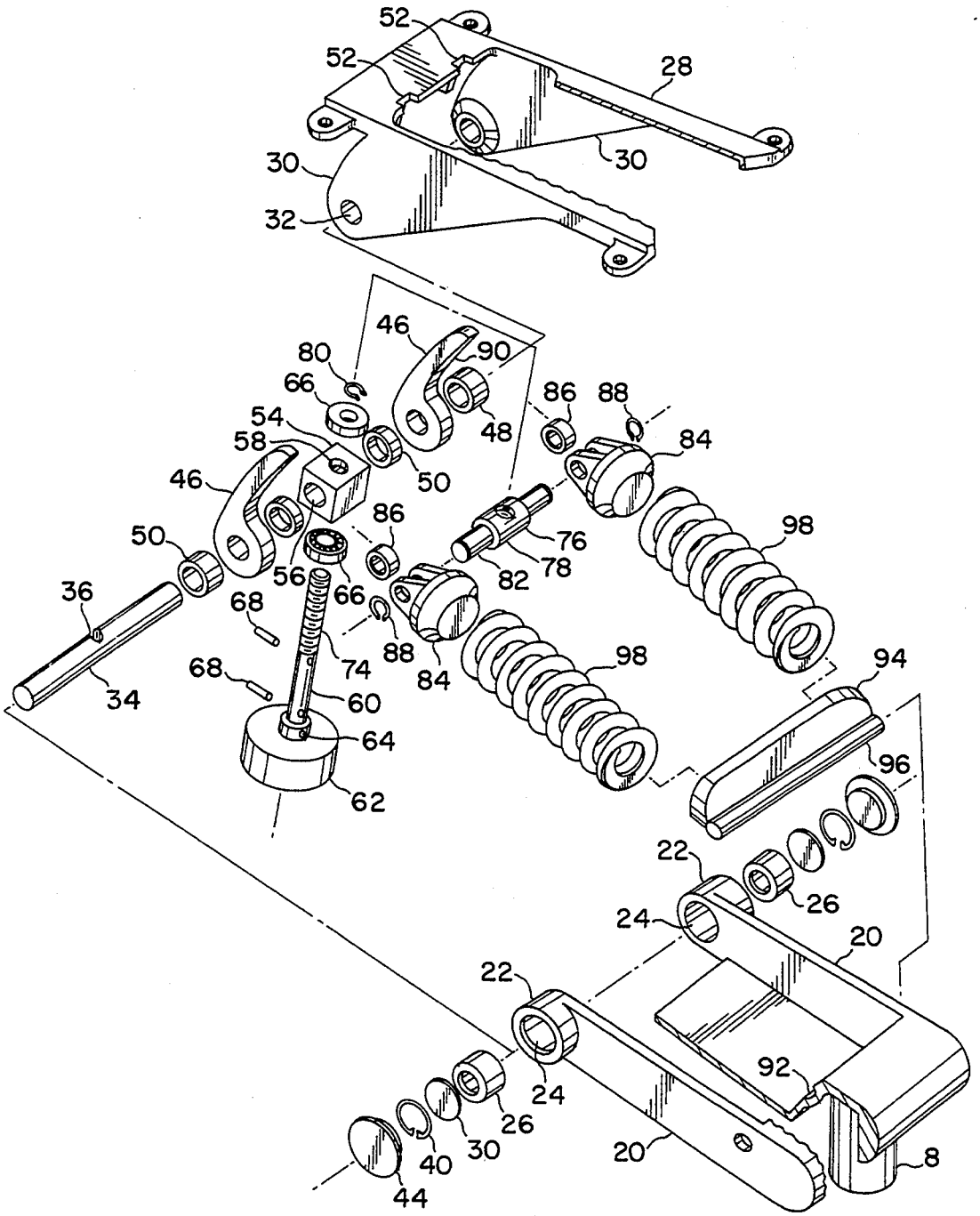
FIG. 5 is an exploded view of the parts of the mechanism of Applicant's invention.

Referring to FIGS. 1-5, shown therein is the first embodiment of the present invention. In particular, the reclining chair 2 comprises a seat portion 4 and a back portion 6 which are formed integrally. The reclining chair 2 further includes a base 8 which is rotatably coupled to a pedestal 10 by means of a tapered cup 12 which rotatably engages with a tapered pin 14. The pedestal 10 is further provided with legs 16 on which are provided rollers 18.

The base 8 further comprises two forwardly projecting arms 20. The forwardly projecting arms 20 are further provided at their ends with cylindrical portions 22 which are provided with bores 24 into which are fitted bearings 26.

The bottom of the seat portion 4 is provided with a mounting plate 28 and the mounting plate 28 is provided in the forward portion thereof with downwardly extending arms 30. Bores 32 are provided in each of the arms 30. The arms 30 project downward and extend between the forwardly extending arms 20 of the base 8 and a rod 34 with a transverse hole 36 is provided through the bearings 26 and the bores 32 to rotatably couple together the mounting plate 28 and the base 8. The open ends of the cylindrical portions 22 are closed by means of spacers 38, snap ring 40 which snaps into a groove 42 provided in the bore 24 and an end cover 44 which is fitted into the bore 24.

Upwardly extending arms 46 are rotatably provided on the rod 34 and spaced apart by means of large and small spacers 48 and 50. The upwardly extending ends of the arms 46 fit into and are held by the slots 52 provided in the mounting plate 28. In this way, the arms 46 are caused to rotate together with the mounting plate 28 around the rod 34 relative to the arms 20.

A block 54 having a bore 56 through which the rod 34 extends is provided between the small spacers 50. The block 54 is further provided with a bore 58 which is provided perpendicularly to the bore 56 and is aligned with the bore 36 in the rod 34. A threaded rod 60 is coupled to a knob 62 by means of a pin 64 and the rod 60 is inserted through the bores 36 and the rod 34 and the bore 58 in the block 54 and thrust and load bearings 66 are provided on both sides of the block 54 with the rod 60 projecting therethrough. The rod 60 together with the bearing 66 are held in place by a means of pins 68.

The rod 60 is further provided with a threaded portion 74 which is threadably engaged with a threaded bore 76 provided in the rod 78. The end of the threaded portion 74 is further provided with a restraining snap ring 80 which engages with a groove provided adjacent the end of the threaded portion 74. The restraining snap ring 80 presents the threaded portion 74 of rod 60 from being completely unthreaded from threaded bore 76 in rod 78.

The rod 78 is provided at both ends with reduced diameter portions 82. On the reduced diameter portions 82 are provided forked spring retainers 84 and rollers 86 are provided between the forks of the spring retainers 84. The forked spring retainers 84 are retained upon the reduced portions 82 by means of retaining clips 88 which are provided in grooves adjacent the ends of the reduced diameter portions 82. The rollers 86 rotatably engage with the engaging surface 90 of the arms 46.

A semi-circular groove 92 extending transversely of the base 8 is provided in the base 8 adjacent to the tapered cupped portion 12. A spring retaining plate 94 having a longitudinally extending semi-circular projection 96 is rotatably coupled to the base 8 by inserting the semi-circular portion 96 into the groove 92 to form a pivotal connection. Coil springs 98 are provided between the forked spring retaining members 84 and the spring retaining plate 94 and by rotating the knob 62 the point of engagement between the roller 86 and the engaging surface 90 of the lever arms 46 can be varied and the spring pivoted around or about the groove 92.

Furthermore, the rod 34 is provided at a point parallel to an axis passing through a knee joint of an average adult (U.S. statistics) person (50% percentile) sitting in the chair 2.

Figure 8A:
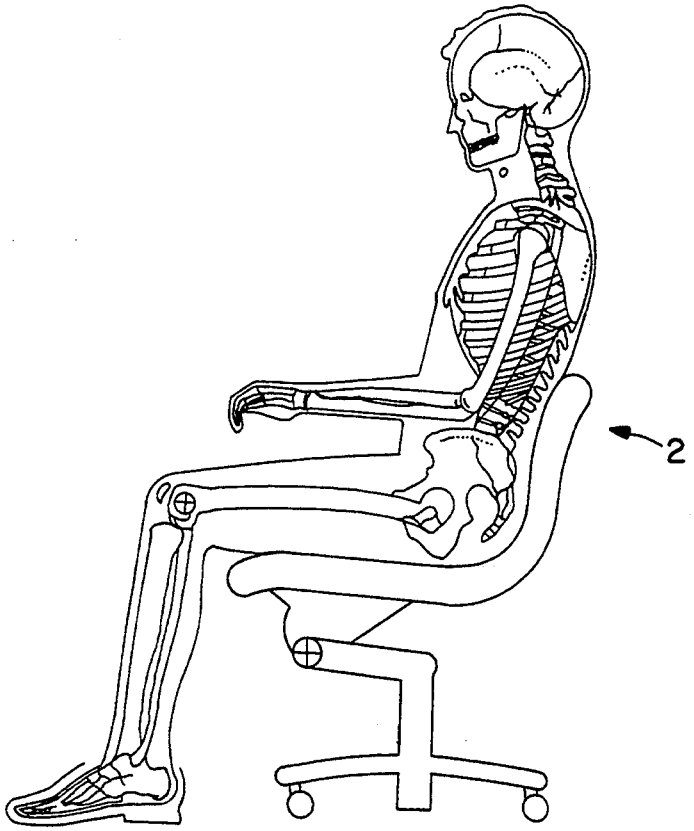
FIGS. 8A and 8B are simplified views illustrating the reclining motion of the present invention.
Figure 8B:
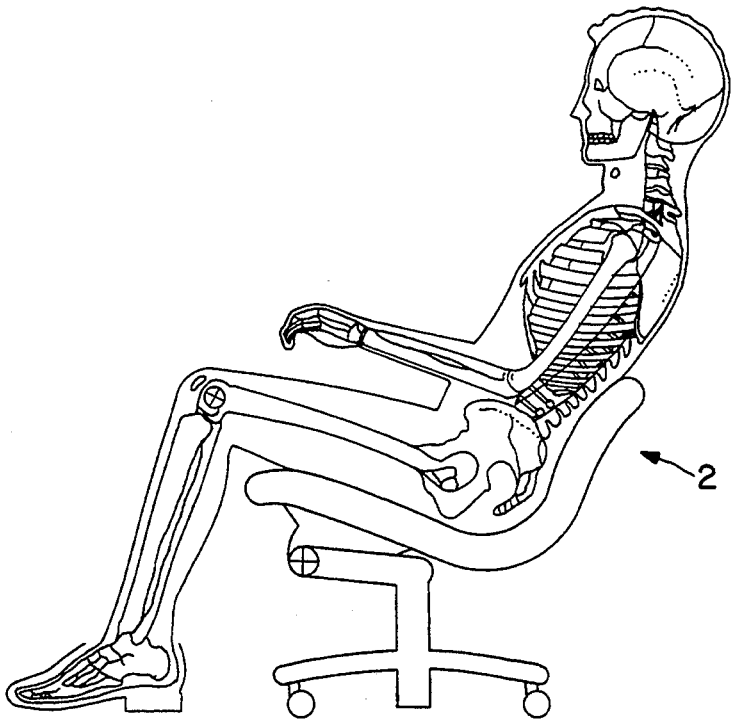

In operation, an individual sits in the reclining chair as is illustrated in FIG. 8A. Since the pivot point formed by the rod 34 is provided parallel to an axis passing through a knee joint of a person sitting in the chair 2, the chair 2 reclines about an axis provided in parallel to an axis extending through the knee joint of a person seated in the reclining chair 2 and reclines without raising the person's feet from the floor or causing the person discomfort, as is shown in FIG. 8B.

Figure 6:
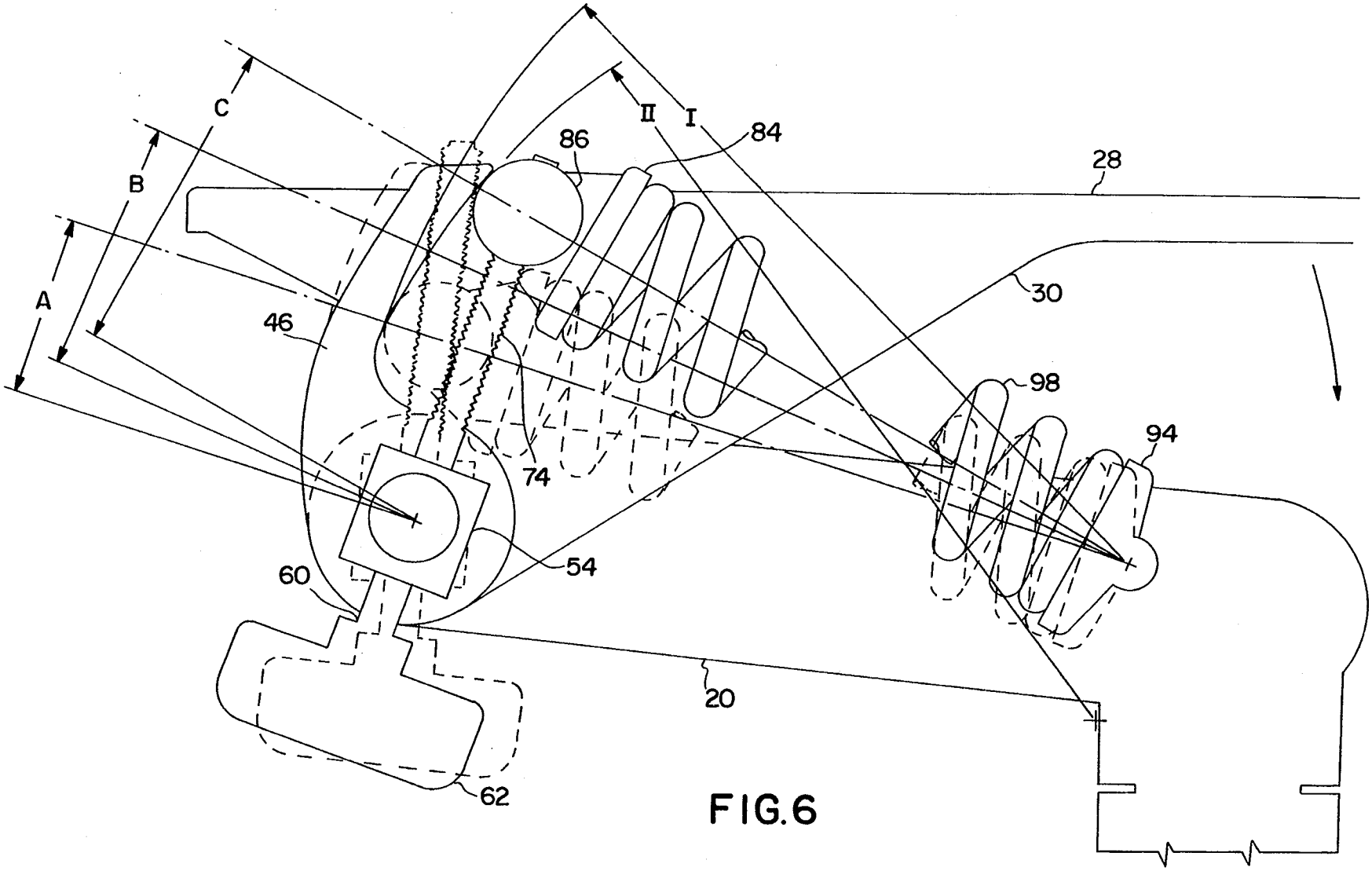
FIG. 6 is a simplified view similar to FIG. 1.
Figure 7A:
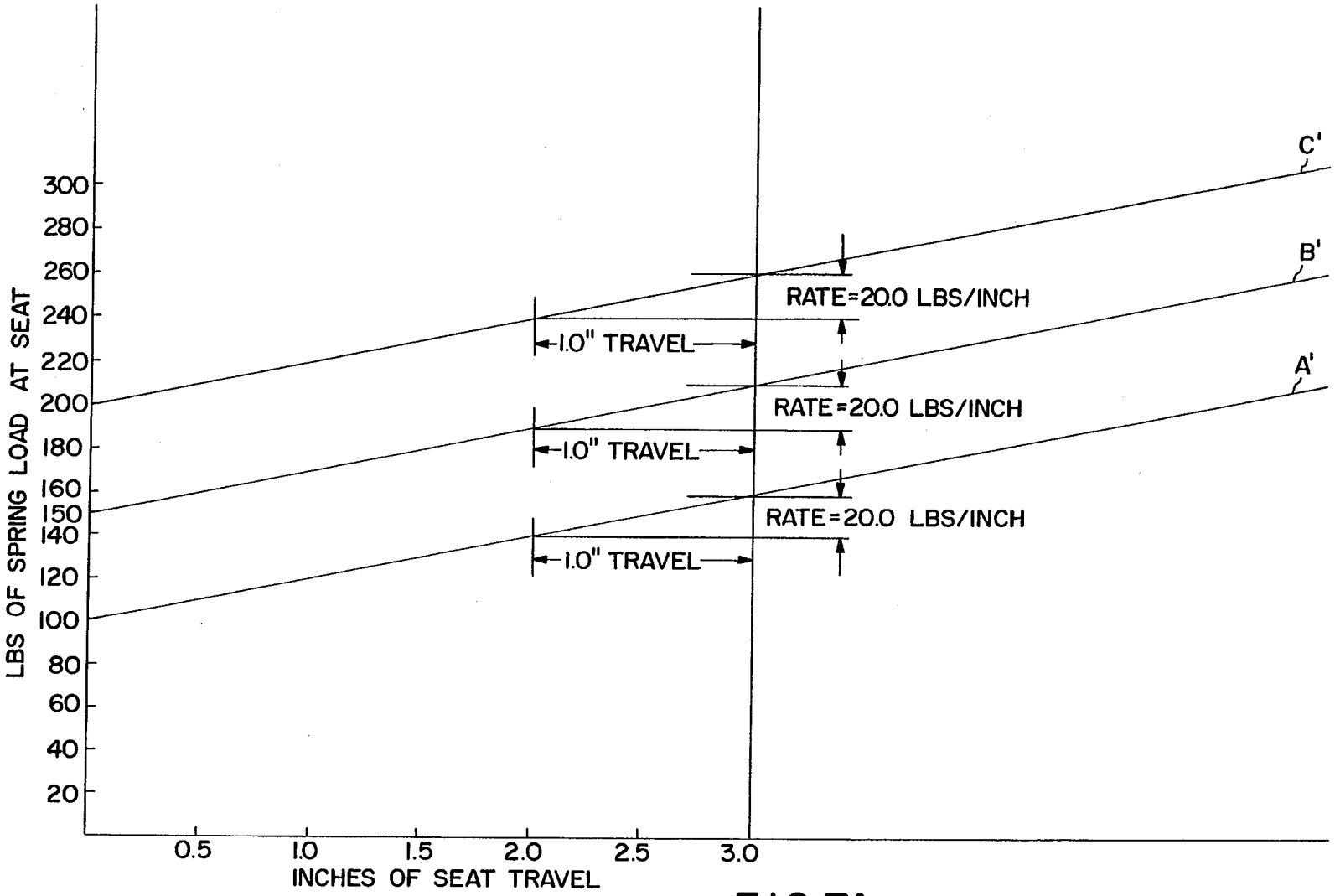
FIG. 7A, 7B and 7C illustrate respectively load vs seat travel for a conventional mechanism, load vs seat travel for the present invention and load curve comparisons for the conventional mechanisms and the present invention.
Figure 7B:
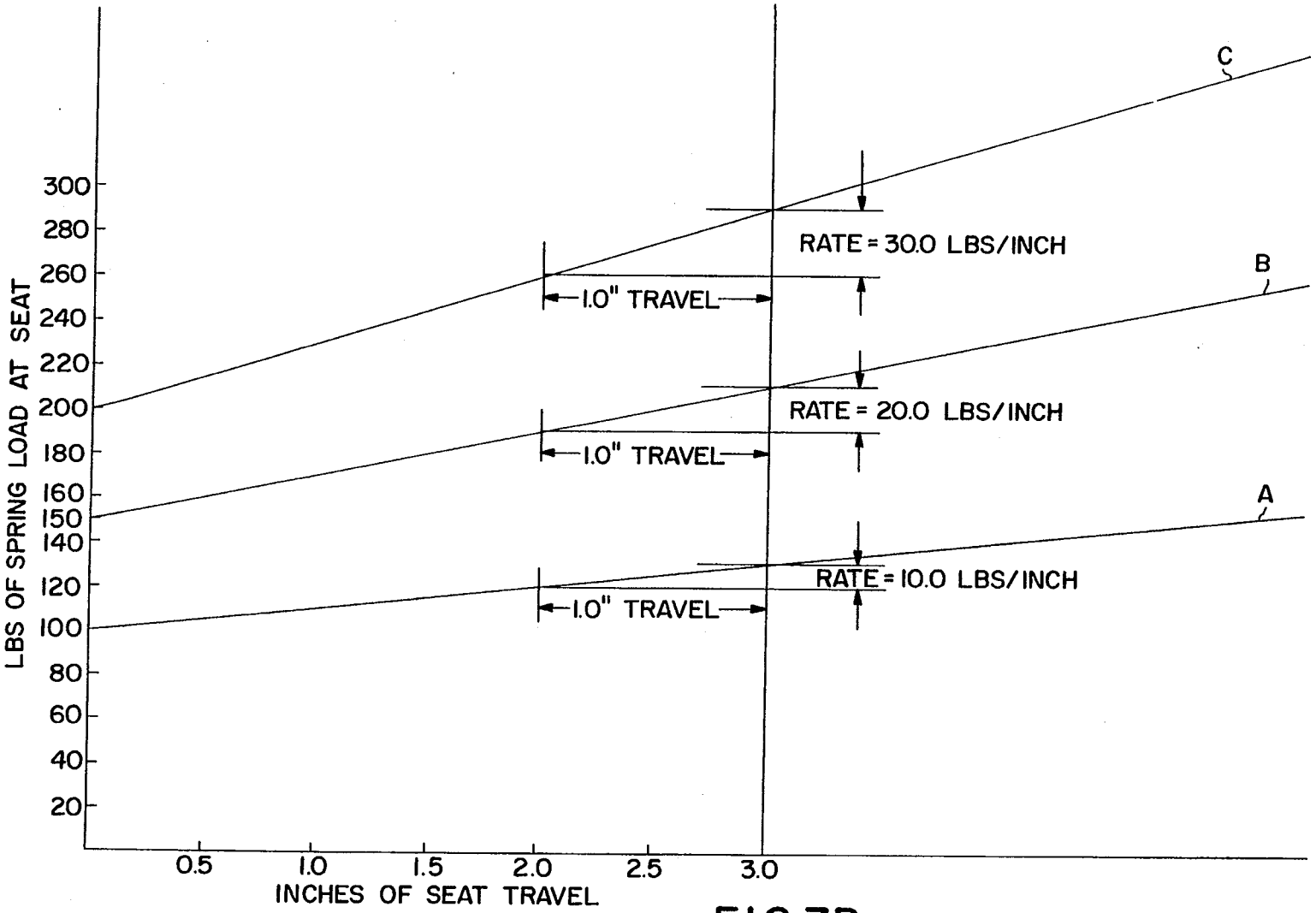

Still further and as is shown in FIG. 6, since the point of engagement between the roller 86 and the engaging surface 90 of the lever arm 46 may be changed, the leverage ratio of the lever arm acting on the coil spring 98 can be effectively changed. As a result, the effective spring constant of the coil spring 98 which generates an opposing force as the chair 2 is reclined can be varied. This variation is shown in FIG. 7B. As is shown in FIG. 7B, as the roller is moved to a point further from the rod 34 (distances B and C in FIG. 6), the effective spring constant or in other words the force per unit travel of the spring as it is compressed increases nonlinearly. Alternately, as the roller 86 is moved to a point on the engaging surface 90 closest to the rod 34 (distance A in FIG. 6), the effective spring constant is a minimum. As a result and as is shown in FIG. 7B, the effective spring rate increases from the soft setting at the distance A of 10 lbs per inch of travel to 20 lbs per inch of travel for the medium setting at the distance B and then to a rate of 30 lbs per inch for the hard setting shown by the line C in FIG. 7B for the distance C in FIG. 6. In comparison thereto, in FIG. 7A is shown the conventional soft, medium and hard settings A', B', C', respectively. In all cases the rate is a constant 20 lbs per inch of travel. Accordingly, it should be apparent that the conventional system is essentially optimized to be utilized only for the medium setting.

Figure 7C:
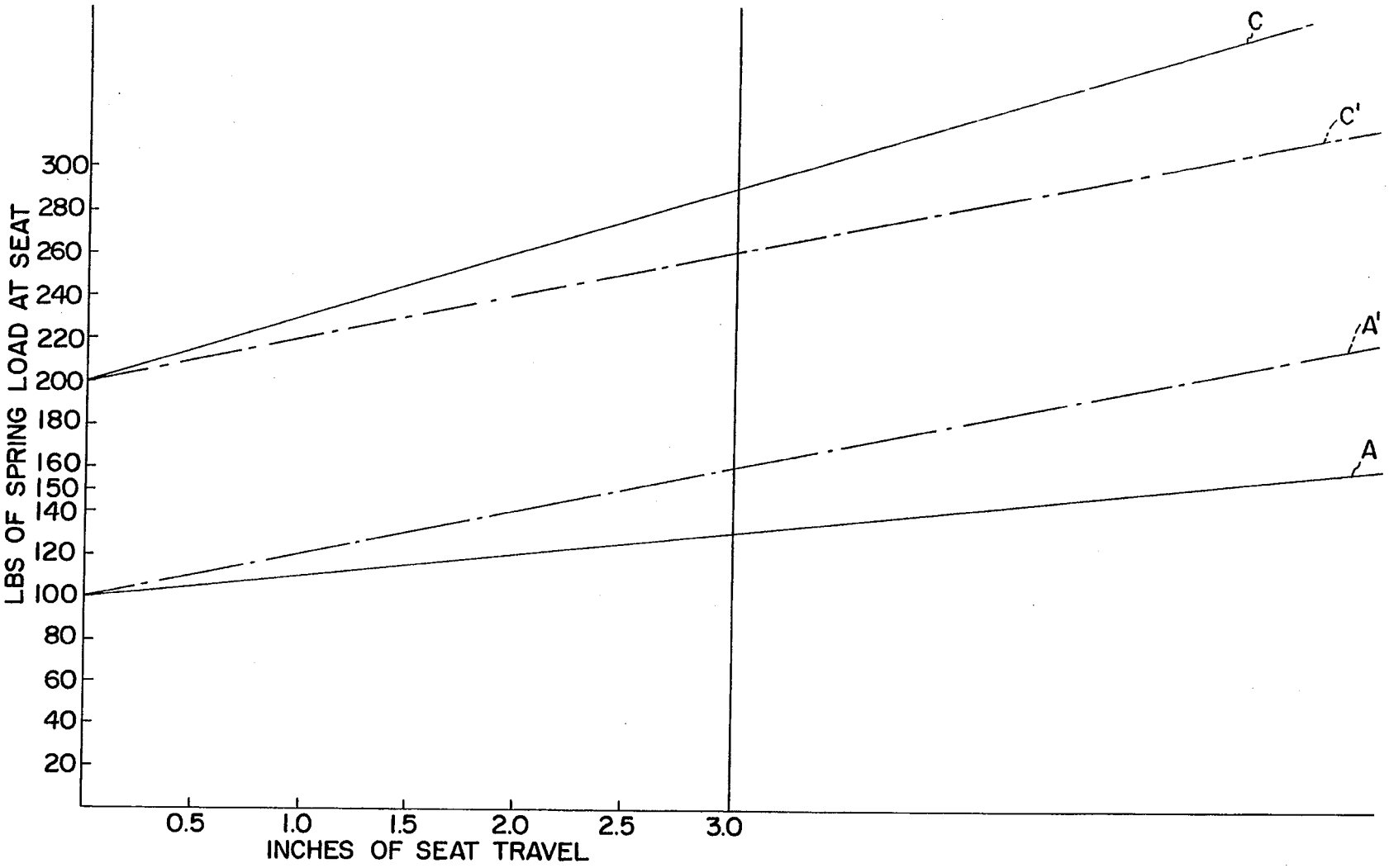

Still further, referring to FIG. 6, it should be apparent that the lever arm 46 is not of constant thickness and is provided with an increasing thickness towards the end of the lever arm as is shown by the double crosshatched portion of the lever arm 46 in FIG. 6. This double crosshatched increased thickness portion of the lever arm 46 is defined by a radius I from the pivot point 92 of the spring holder 94 and another radius II. This radius II is selected so that it provides an increasing thickness of the lever arm 46 so that the preload on the reclining chair can be simultaneously varied with the effective spring rate. The importance of this simultaneous variation in the preload with the change in the effective spring rate is apparent from FIG. 7C. Looking first at the line A which represents the effective biasing force of the spring per inch of travel of the seat of a reclining chair incorporating the present invention and comparing it with the dashed line A' which illustrates the biasing force of the spring of a conventional reclining chair. As is apparent from comparing the lines A and A', as the seat of the reclining chair is reclined the biasing force for the soft setting becomes too hard with the conventional design. Alternately, looking at the line C which represents the hard setting for the distance C in FIG. 6 of the present invention and the dashed line C' which represents the hard setting for a conventional chair, it should be apparent that as the conventional chair is reclined, the biasing force becomes too soft. As a result in either case the individual sitting in the chair becomes uncomfortable the more the chair is reclined with the conventional chair. As a result of this construction of the present invention, by rotating the knob 62 to simultaneously vary the preload and effective spring rate, the reclining chair 2 can be made to recline comfortably for persons over a weight range of approximately 90 lbs. to 290 lbs., or in other words of a weight ratio 3 to 1.

As a result of the construction of the reclining chair of the present invention and as is described above, not only can a reclining chair be provided which is comfortable because it does not raise the person seated therein's feet from the floor, but also provides a comfortable resisting force to individuals of different weights over a large range by providing simultaneous adjustment of the preload and spring rate.

It should be apparent to those skilled in the art for the above described embodiments are merely illustrative but a few of the possible embodiments of the present invention and numerous and other embodiments could be created without departing from the spirit and scope of this invention.

We claim:

1. A reclining chair comprising:

a support base;

a chair comprising a seat portion and a back portion integrally formed with the seat portion;

at least one lever arm fixed to and extending from the bottom and forward portions of said seat portion, said lever arm having an engaging surface along a length thereof;

a means for pivotally coupling said forward portion of said seat portion to said base portion such that said seat portion pivotally moves substantially about a pivoting axis located adjacent said forward portion;

a roller means engaging with said engaging surface of said lever arm;

a means for moving said roller means along said engaging surface and presetting an engaging position between said roller means and said engaging surface; and a coil spring means pivotally coupled at one end to said support base and rotatably coupled to said roller means at another end;

whereby a force per unit distance of recline of said seat portion as said chair is reclined may be varied and a reclining chair which is comfortable to sit in by both heavy and light persons is provided.

2. A reclining chair according to claim 1, wherein said lever arm is further provided with a preload ramp portion of increasing thickness in a direction along a line extending from a connection of the lever arm to the seat portion toward a free end of said lever arm.

3. A reclining chair comprising:

a support base;

a chair comprising a seat portion and a back portion integrally formed with said seat portion;

at least one lever arm fixed and extending from a bottom and forward portion of said seat portion, said lever arm having an engaging surface along a length thereof;

a means for pivotally coupling the forward portion of said seat portion to said base portion such that said seat portion pivotally moves substantially about a pivoting axis located adjacent said forward portion;

a roller means engaging with said engaging surface of said lever arm;

a means for moving said roller means along said engaging surface and presetting an engaging position between said roller means and said engaging surface; and a coil spring means pivotally coupled between said support base and said roller means;

whereby a force per unit distance of recline as said seat portion is reclined may be varied and a reclining chair which is comfortable to sit in by both heavy and light persons is provided.

4. A reclining chair according to claim 3, wherein said lever arm is further provided with a preload ramp portion of increasing thickness in a direction extending from a connection of the lever arm to the seat portion toward a free end of said lever arm.

* * * * *